United States Patent [19]

Haber et al.

[11] Patent Number: 4,752,093

[45] Date of Patent: Jun. 21, 1988

[54] WASTE MATERIAL DISPOSAL SYSTEM

[76] Inventors: William Haber, 5812 Donna Ave., Tarzana, Calif. 91356; Jack Takeshita, 12816 Montague St., Pacoima, Calif. 91331

[21] Appl. No.: 40,545

[22] Filed: Apr. 17, 1987

[51] Int. Cl.[4] ..... A01K 29/00

[52] U.S. Cl. ..... 294/1.3; 15/104.8

[58] Field of Search ..... 294/1.3–1.5, 294/25, 55; 2/16, 20, 159; 15/104.8, 227, 257.1, 257.6; 206/496; 383/4, 6, 25, 33, 34

[56] References Cited

U.S. PATENT DOCUMENTS

| | | | |
|---|---|---|---|
| 3,767,247 | 10/1973 | Wetzler | 15/257.1 X |
| 3,837,696 | 9/1974 | Dahlke | 294/25 X |
| 3,850,467 | 11/1974 | Johnson | 294/25 X |
| 3,936,087 | 2/1976 | Alexander | 294/1.3 X |
| 4,103,952 | 8/1978 | Thompson | 294/55 X |
| 4,138,153 | 2/1979 | Brown | 294/55 X |
| 4,215,886 | 8/1980 | Naderi et al. | 294/1.3 |

FOREIGN PATENT DOCUMENTS

| | | | |
|---|---|---|---|
| 3518908 | 11/1986 | Fed. Rep. of Germany | 294/1.3 |
| 2100581 | 1/1983 | United Kingdom | 294/1.3 |

*Primary Examiner*—Johnny D. Cherry

*Attorney, Agent, or Firm*—Poms, Smith, Lande & Rose

[57] ABSTRACT

In order to collect and dispose of waste material, a plastic bag or sleeve is provided with a collar at the mouth of the bag and a ramp secured inside and at the bottom of the bag. In use, the collar is pulled back to expose the end of the ramp, and the waste material is shifted onto the ramp using either a disposal scoop or a mitten-like pocket in the side of the bag into which one's hand may extend, to manually shift or place the waste material on the ramp. The collar is then extended over the end of the ramp so that the bag encloses the waste material and the bag is sealed in any convenient way, for example, by using pressure-sensitive material or a mechanical latch.

20 Claims, 4 Drawing Sheets

WASTE MATERIAL DISPOSAL SYSTEM

FIELD OF THE INVENTION

This invention relates to waste disposal arrangements.

BACKGROUND OF THE INVENTION

Many arrangements have been proposed heretofore for the disposal of waste material such as dog dirt, diseased material, or the like. Several such prior art arrangements are disclosed in J. D. Thompson U.S. Pat. No. 4,103,952, granted Aug. 1, 1978; J. Wagner U.S. Pat. No. 2,497,749, granted Feb. 14, 1950; and in Great Britain Patent Application No. 2,100,581, published Jan. 6, 1983.

However, all of the known prior arrangements have significant drawbacks in that they do not effectively protect the user from contamination, do not seal the waste material, are inconvenient to use, or have other drawbacks or disadvantages.

Accordingly, a principal object of the present invention is to provide a waste disposal system or device which overcomes the foregoing problems and disadvantages.

SUMMARY OF THE INVENTION

In accordance with the present invention, a disposable bag is provided with a collar secured to the open end thereof, and a ramp secured within and toward the closed end of the bag. In use, one end of the ramp is initially exposed from the front end of the bag, with the collar part way down the ramp, and the bag or sleeve somewhat bunched up between the sleeve and the other end of the ramp. The unit is then bowed to open up the open end of the bag at the collar. The waste material is then shifted onto the ramp using, for example, a small disposable scoop, or a mitten-like pocket in the side of the bag into which one may place one's hand to load the waste material onto the ramp. The collar is then pulled forward over the waste material and the ramp, and the outer end of the bag is sealed.

Any convenient technique may be used to seal the bag, with two of many possible methods being the use of pressure-sensitive material, or a mechanical interlock on the flexible collar. The ramp may conveniently be provided with a handle extending from the closed end of the bag.

Other objects, features and advantages of the invention will become apparent from a consideration of the following detailed description and from the accompanying drawings.

DETAILED DESCRIPTION

Figure 1:
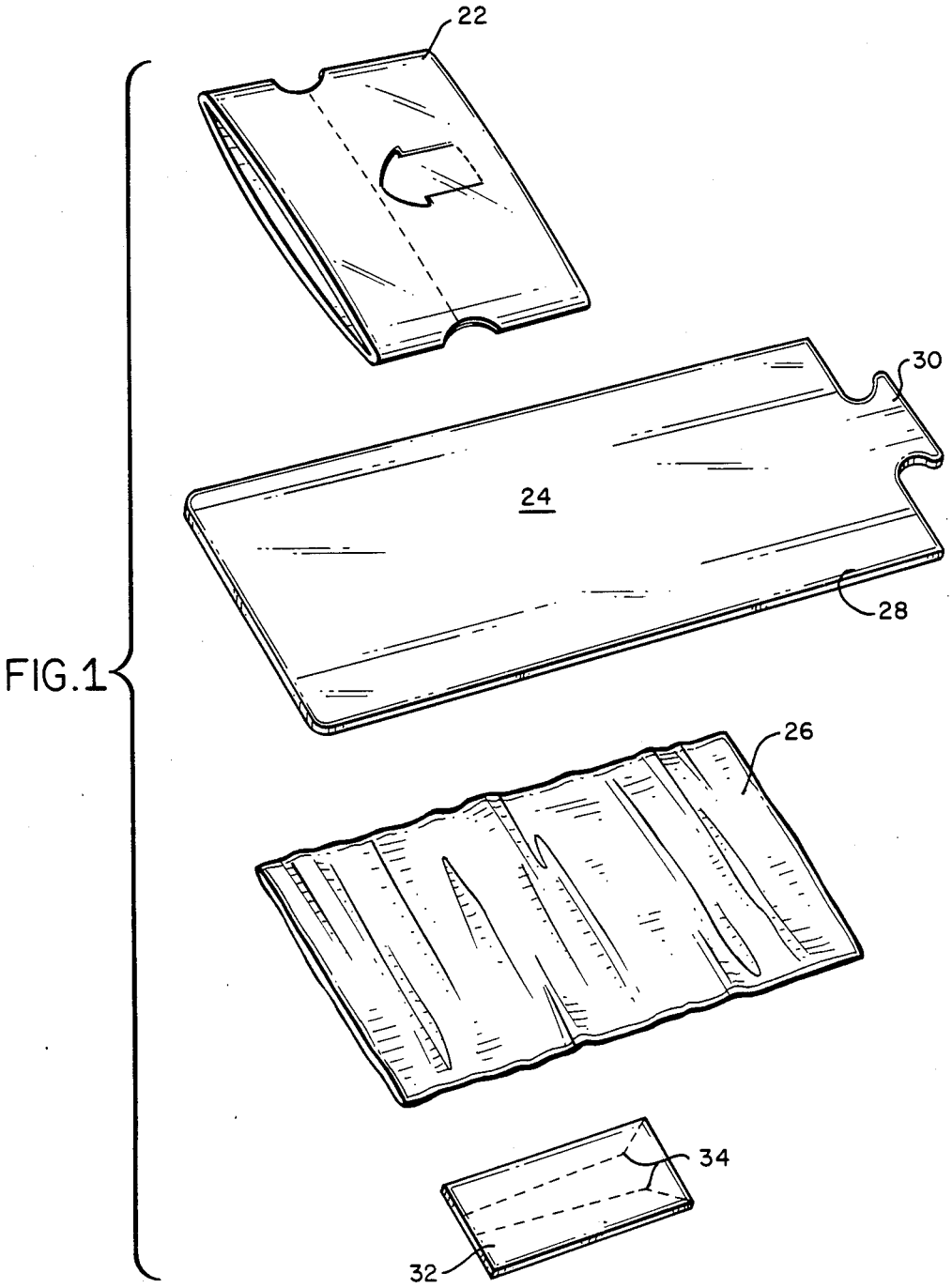
FIG. 1 is an exploded view of the components making up an assemblage illustrating the principles of the present invention.

Referring more particularly to the drawings, FIG. 1 is an exploded view of the elements which go into forming a waste disposal assemblage or system illustrating the present invention. In FIG. 1, the collar 22 is dimensioned to fit over the ramp 24, and it is secured to one end of the plastic bag or sleeve 26. The other end of the plastic bag or sleeve 26 is sealed to the end 28 of the ramp 24 adjacent the handle 30. A scoop 32 is provided which may be folded along the score lines 34 to increase its usefulness and strength, as will be shown hereinbelow.

Figure 2:
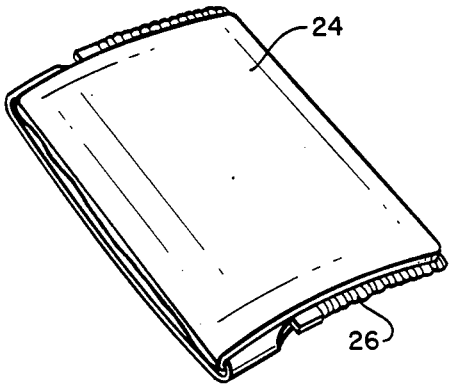
FIG. 2 is a showing of the unit folded up as it may be purchased or supplied.
Figure 3:
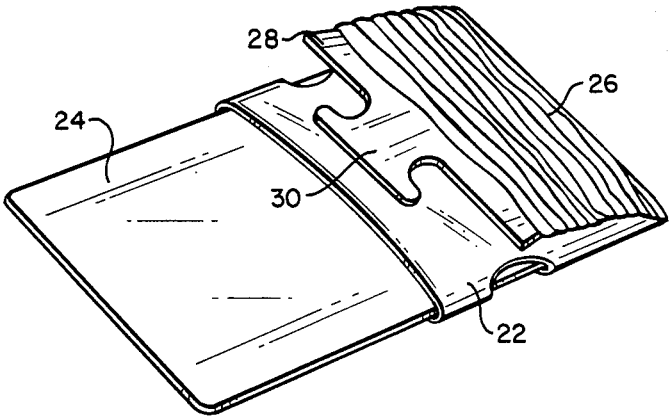
FIG. 3 shows a partially unfolded configuration of the waste disposal assemblage of the present invention.
Figure 4:
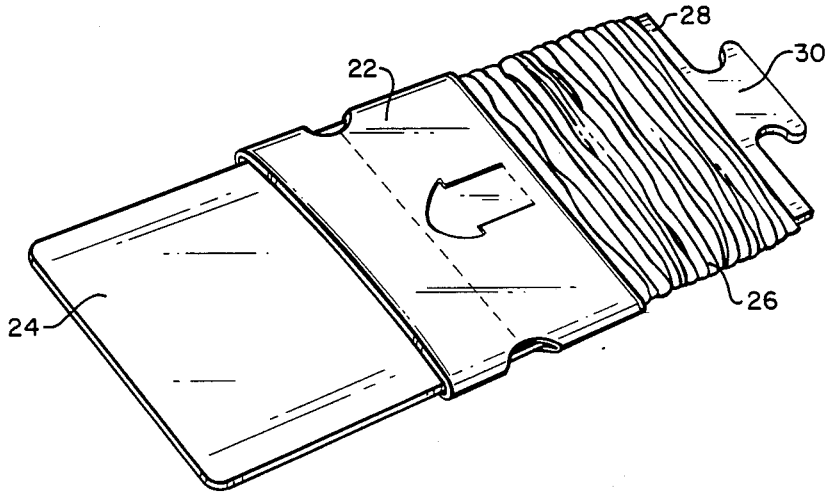
FIG. 4 shows a further extension of the unit of FIGS. 1 through 3 with the sleeve overlying the ramp.

FIG. 2 shows the assemblage of the present invention, including the parts shown in FIG. 1, in its assembled and folded configuration. FIG. 3 shows the unit of FIG. 2 partially unfolded with the ramp 24 protruding from the collar 22, and the plastic bag or sleeve 26 secured at one end to the collar 22, and at the other end to the end 28 of the ramp 24 adjacent the handle 30. Incidentally, by way of example but not of limitation, the ramp 24 and the collar 22 may be formed of cardboard, or lightweight, flexible semi-rigid plastic material. The bag 26 is highly flexible and may be made of thin gauge plastic of a composition appropriate to contain the waste material which is to be disposed. The plastic bag or sleeve 26 may be secured to the collar 22 and the ramp 24 by suitable adhesive material, or by plastic tape, by way of example.

Figure 5:
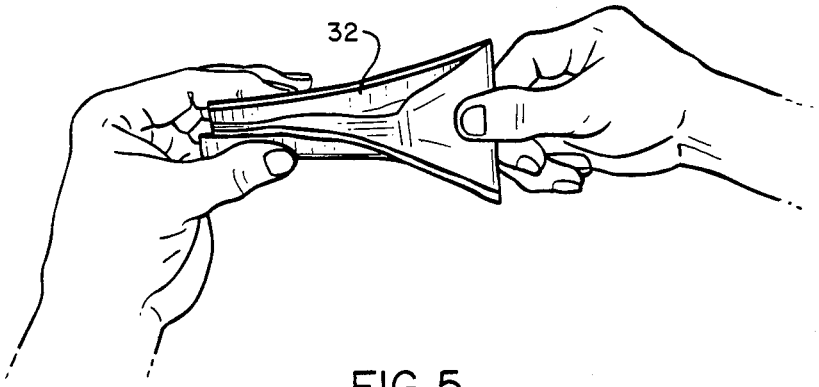
FIG. 5 shows a cardboard scoop which may be folded into the indicated configuration for use.

FIG. 5 shows the scoop 32 folded up along the fold or score lines shown in FIG. 1, in order to provide increased strength and rigidity for scooping action.

Figure 6:
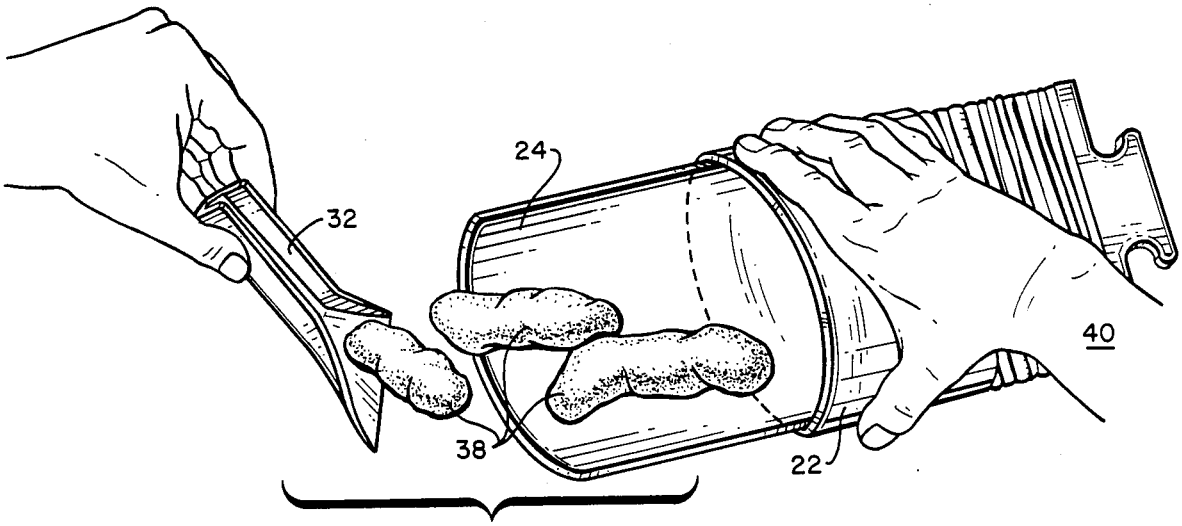
FIG. 6 shows the unit in use, with the scoop being employed to shift waste material onto the ramp.
Figure 7:
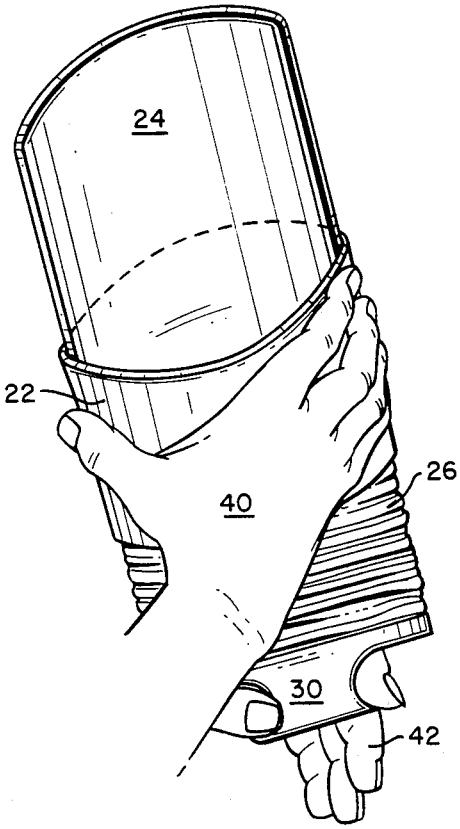
FIG. 7 shows the step of retracting the ramp into the plastic bag.
Figure 8:
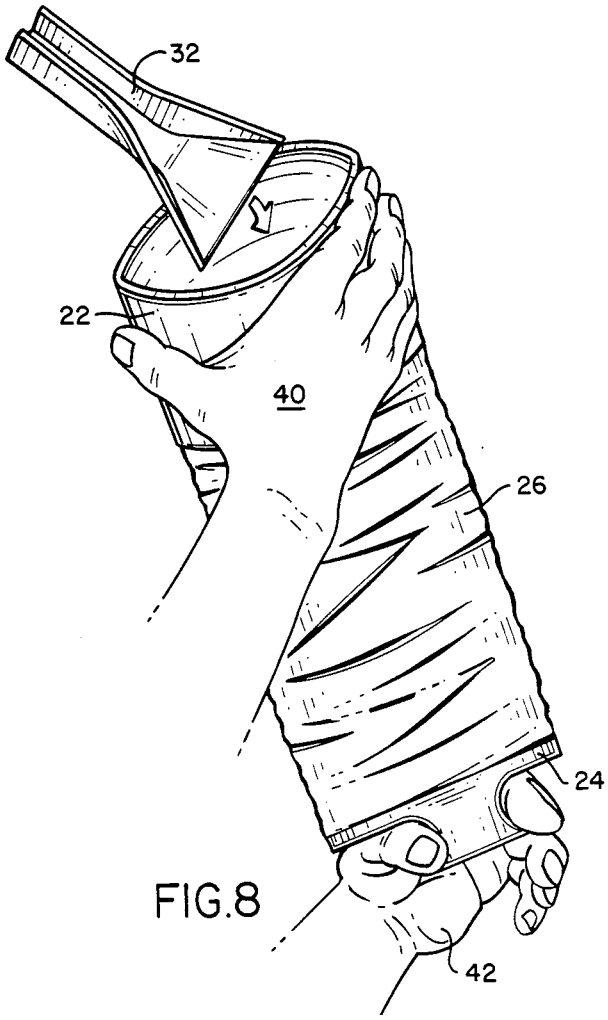
FIG. 8 indicates the full retraction of the ramp into the bag, and the disposal of the contaminated scoop into the bag.
Figure 9:
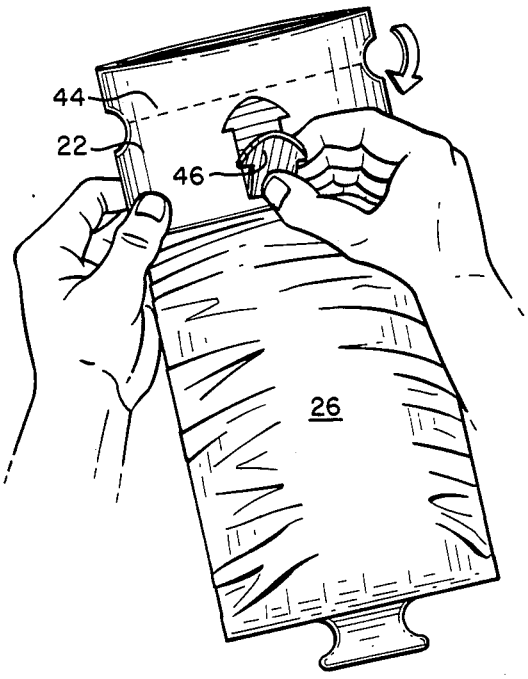
FIGS. 9 and 10 show the mechanical closing of the upper end of the bag using the collar and a mechanical interlocking arrangement.
Figure 10:
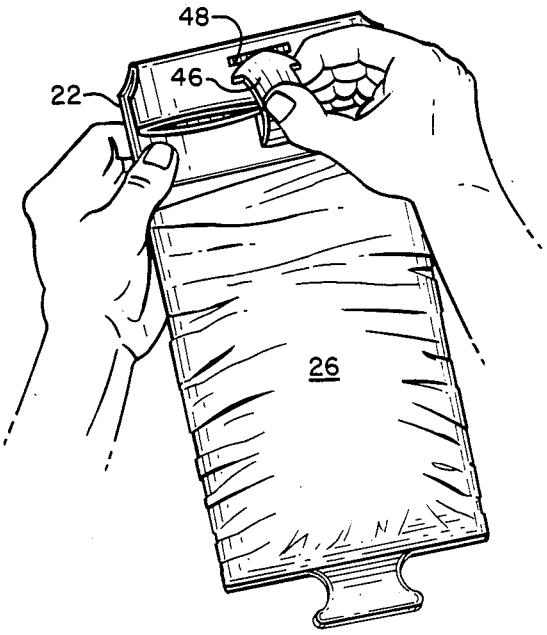

FIG. 6 shows the unit in action whereby the scoop 32 is being employed to shift the dog dirt or other waste material 38 onto the ramp 24, while the unit is held in a somewhat bowed configuration by the hand 40 exerting inward pressure on the collar 22. As shown in FIG. 7, the unit is then tilted with the outer end of the ramp 24 upward, and the hand 42 grips the handle 30 and pulls the ramp 24 down inside the bag or sleeve 26 so that the ramp 24 is completely within the bag or sleeve 26. As shown in FIG. 8, the cardboard scoop 32 which has been soiled or contaminated by engagement with the waste material, may then be dropped into the unit, through the collar 22 which is still being held by the hand 40, while the hand 42 has pulled the ramp 24 entirely into the bag 26, which is now fully extended.

To seal the upper end of the bag 26, the collar 22 is folded about the score line 44, and the locking member 46, which resembles an arrow, is inserted into the slot 48 to complete the sealing of the assemblage.

Figure 11:
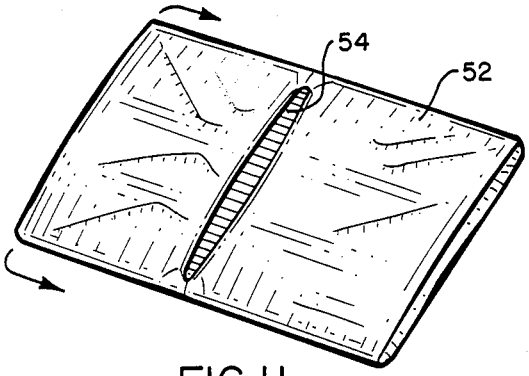
FIG. 11 shows an alternative arrangement in which the plastic bag or sleeve is provided with a mitten-like pocket.
Figure 12:
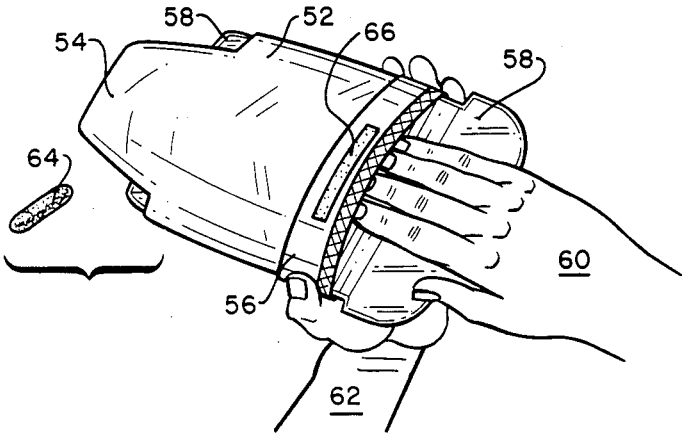
FIG. 12 shows an assemblage similar to that of FIGS. 1 through 10, but wherein the waste material may be disposed of manually.
Figure 13:
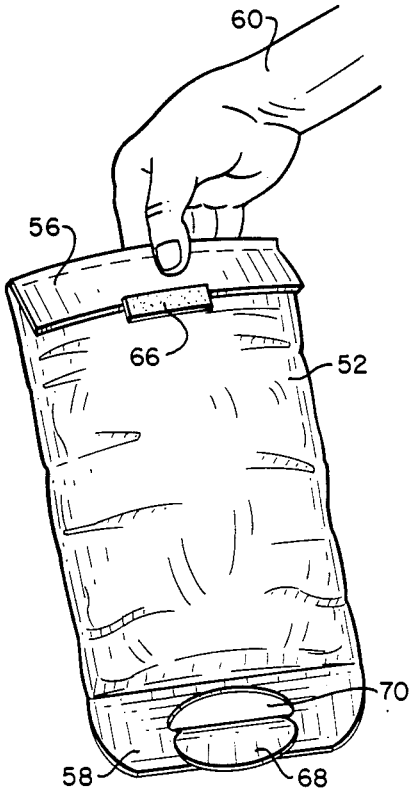
FIG. 13 shows the assemblage of FIG. 12 sealed, using self-adhesive tape.

Referring now to FIGS. 11 through 13, these figures illustrate an alternate embodiment of the invention in which the waste material may be disposed of manually, rather than with a scoop. More particularly, with reference to FIG. 11, the plastic sleeve or bag 52 is provided with a pocket 54 which provides a mitten-like opening for a hand.

FIG. 12 shows a complete assemblage similar to that of FIGS. 1 through 10 wherein one end of the plastic sleeve 52 is secured to the collar 56, and the other end of the sleeve 52 is secured to the ramp 58 at its end shown in FIG. 12 adjacent the hands 60 and 62. Incidentally, in FIG. 12, the hand 60 is reaching into the mitten-like pocket 54 so that the waste material 64 may be manually shifted onto the outer end of the ramp 58. Incidentally, with reference to FIG. 12, the strip of self-adhesive tape 66 is subsequently employed to seal the bag. Following shifting of the waste material 64 onto the ramp 58, the collar 56 is advanced to the left, as shown in FIG. 12, so that the waste material drops down into the bag. The collar 56 is then folded over as indicated in FIG. 13, and the self-adhesive tape 66 is shifted to the position shown in FIG. 13 wherein the collar is secured to the bag or sleeve 52. The ramp 58 is provided with a foldable portion 68 to provide the opening 70 which may be employed as a handle when the ramp 58 is being pulled back into the bag 52 and the collar 56 is advanced.

Concerning materials, the bags or sleeves may be formed of very flexible and pliable plastic of the type used for food packaging or storage, and may be opaque or transparent. Heavier duty materials, having bacteriacidal and/or radiopaqued properties, for example, may be used, and special coatings of the types noted above, may be employed depending on the waste material to be handled. The ramp, collar and scoop may be made of cardboard, or other sheet material such as plastic, having self-sustaining stiffness but being moderately flexible and bendable.

In conclusion, it is to be understood that the foregoing drawings and the accompanying detailed description refer to one illustrative embodiment of the invention. Various modifications and changes are possible without departing from the spirit and scope of the invention. By way of example and not of limitation, when radioactive material is being employed, the bag may be impregnated with material having a high resistance to the transmission of the radioactive material. In addition, instead of the handles as shown in the two embodiments of the invention being formed as part of the ramp, the ramp may be wholly within a bag having a closed end, and handles may be secured to the outer surface of the bag at the closed end thereof. Accordingly, it is to be understood that the present invention is not limited to the precise structure as shown in the drawings and as described in the detailed description.

We claim:

1. A system for collecting and disposing of waste material without contamination or soiling of the hands, comprising:

a flexible bag having an open end and a closed end;

ramp means secured to the closed end of said bag;

means for changing the length of said bag around the outside of said ramp means while maintaining a single side of said bag facing outward, said changing means including a collar secured around the opening of said bag;

said ramp means extending out from the open end of said bag when said collar is in an intermediate position on said ramp means;

means for engaging waste material and placing it on said ramp means, whereby when said collar is pulled forward, the bag fully encloses the waste material and the outer end of said ramp means; and means for sealing the open end of said bag.

2. A system for collecting and disposing of waste material as defined in claim 1 wherein said engaging means is a short disposable scoop having a length less than the length of said bag, so that following use, the scoop may be placed and sealed within said bag.

3. A system for collecting and disposing of waste material as defined in claim 1 wherein said engaging means is a pocket of mitten-like configuration in the side of said bag for receiving a hand so that the waste material may be manually shifted onto said ramp means.

4. A system for collecting and disposing of waste material as defined in claim 1 wherein said sealing means includes pressure-sensitive adhesive.

5. A system for collecting and disposing of water material as defined in claim 1 wherein said sealing means includes mechanical latching means associated with said collar.

6. A system for collecting and disposing of waste material as defined in claim 1 wherein said bag has an extent greater than the length of said ramp means within said bag or sleeve, whereby said bag completely encloses the contaminated portion of said ramp means when the collar is pulled forward and sealed.

7. A system for collecting and disposing of waste material as defined in claim 1 wherein said ramp means and said collar are made of cardboard.

8. A system for collecting and disposed of waste material as defined in claim 1 wherein said ramp means and said collar are made of sheet material having self-sustaining stiffness but being flexible and bendable.

9. A system for collecting and disposing of waste material as defined in claim 1 further comprising handle means secured to said ramp means adjacent the closed end of said bag for gripping said ramp means as the collar is moved forward to enclose the waste material.

10. A system for collecting and disposing of waste material without contamination or soiling of the hands, comprising:

a flexible bag having an open end and a closed end;

ramp means secured to the closed end of said bag;

means for changing the length of said bag around the outside of said ramp means while maintaining a single side of said bag facing outward, said changing means including a collar secured around the opening of said bag;

said ramp means extending out from the open end of said bag when said collar is in an intermediate position on said ramp; means means for engaging waste material and placing it on said ramp means, whereby when said collar is pulled forward, the bag fully encloses the waste material and the outer end of said ramp means;

means for sealing the open end of said bag;

said bag having an extent greater than the length of said ramp means within said bag; and handle means secured to said ramp means adjacent the closed end of said bag for gripping said ramp means as the collar is moved forward to enclose the waste material.

11. A system for collecting and disposing of waste material as defined in claim 10 wherein said engaging means is a short disposable scoop having a length less than the length of said bag, so that following use, the scoop may be placed and sealed within said bag.

12. A system for collecting and disposing of waste material as defined in claim 10 wherein said engaging means is a pocket of mitten-like configuration in the side of said bag for receiving a hand so that the waste material may be manually shifted onto said ramp means.

13. A system for collecting and disposing of waste material as defined in claim 10 wherein said sealing means includes pressure-sensitive adhesive.

14. A system for collecting and disposing of water material as defined in claim 10 wherein said sealing means includes mechanical latching means associated with said collar.

15. A system for collecting and disposing of waste without contamination or soiling of the hands, comprising:

a flexible bag having an open end and a closed end;

ramp means secured to the closed end of said bag;

means for changing the length of said bag around the outside of said ramp means while maintaining a single side of said bag facing outward, said changing means including a collar secured around the opening of said bag; and said ramp means extending out from the open end of said bag when said collar is in an intermediate position on said ramp means;

whereby waste material may be located into said bag using said ramp means, and the collar moved forward to encompass the ramp means, the waste material thereby being disposed of in a sealed bag.

16. A system for collecting and disposing of waste material as defined in claim 15 wherein said bag has an extent greater than the length of said ramp means within said bag, whereby said bag completely encloses the contaminated portion of said ramp means when the collar is pulled forward and sealed.

17. A system for collecting and disposing of waste material as defined in claim 15 wherein said ramp means and said collar are made of cardboard.

18. A system for collecting and disposing of waste material as defined in claim 15 wherein said ramp means and said collar are made of sheet material having self-sustaining stiffness but being flexible and bendable.

19. A system for collecting and disposing of waste material as defined in claim 15 further comprising handle means secured to said ramp means adjacent the closed end of said bag for gripping said ramp means as the collar is moved forward to enclose the waste material.

20. A system for collecting and disposing of waste material as defined in claim 15 further comprising means for loading waste material onto said ramp means without touching said waste material.

* * * * *